US007409763B2

(12) United States Patent
Pratt

(10) Patent No.: US 7,409,763 B2
(45) Date of Patent: Aug. 12, 2008

(54) JEWELRY BEAD AND METHOD OF STRINGING SAME

(76) Inventor: Ronald Pratt, 223 Reservoir Rd., Cumberland, RI (US) 02864

( * ) Notice: Subject to any disclaimer, the term of this patent is extended or adjusted under 35 U.S.C. 154(b) by 0 days.

(21) Appl. No.: 11/352,051

(22) Filed: Feb. 10, 2006

(65) Prior Publication Data

US 2006/0213225 A1 Sep. 28, 2006

Related U.S. Application Data

(63) Continuation of application No. 11/076,594, filed on Mar. 10, 2005, now abandoned.

(51) Int. Cl.
*A44C 25/00* (2006.01)
*A44C 5/00* (2006.01)
*A44C 27/00* (2006.01)

(52) U.S. Cl. ..... 29/896.41; 63/38; 63/3.1; 63/34; 29/896.4; 29/447; 59/2

(58) Field of Classification Search ..... 63/38, 63/3.1, 34; 59/2, 78, 80; 29/896.4, 896.41, 29/896.411, 497, 433
See application file for complete search history.

(56) References Cited

U.S. PATENT DOCUMENTS 3,284,882 A * 11/1966 Marchesan ..... 29/433
5,070,586 A * 12/1991 Poll ..... 29/10
5,584,195 A * 12/1996 Liu ..... 63/1.12
5,609,289 A * 3/1997 Boccanfuso ..... 228/173.6
6,026,571 A * 2/2000 Lorenz ..... 29/896.41
6,470,571 B1 * 10/2002 Namiki ..... 29/896.41
6,557,376 B2 * 5/2003 Pratt ..... 63/3
6,722,036 B2 * 4/2004 Pratt ..... 29/896.41
6,739,052 B2 * 5/2004 Pratt ..... 29/896.43
6,901,771 B2 * 6/2005 Ooide ..... 63/26
2002/0166339 A1 * 11/2002 Adelman ..... 63/29.1
2003/0154742 A1 * 8/2003 Ooide ..... 63/38
2004/0129023 A1 * 7/2004 Hofer et al. ..... 63/38
2006/0081003 A1 * 4/2006 MacHock ..... 63/35
2007/0000283 A1 * 1/2007 Murao et al. ..... 63/3.2

OTHER PUBLICATIONS http://en.wikipedia.org/wiki/Polyethylene.*
http://en.wikipedia.org/wiki/Thermoplastic.*
http://insulationplastics.com/insulplast_202.htm.*

* cited by examiner

*Primary Examiner*—Victor Batson
*Assistant Examiner*—David C Reese
(74) *Attorney, Agent, or Firm*—Cesari and McKenna, LLP

(57) ABSTRACT

A jewelry article includes an elongated support and a multiplicity of beads strung along the support. At least one of the beads constitutes a locking bead consisting of a substantially closed hollow shell with a pair of aligned holes sized to slideably receive the support. A heat-shrinkable plastic tube is positioned inside the shell with its opposite ends captured by portions of said shell around the holes. The tube has a heat-deformed inner wall which substantially conforms to the support so as to permanently anchor the bead to the support. A method of stringing the locking bead is also disclosed.

3 Claims, 2 Drawing Sheets

JEWELRY BEAD AND METHOD OF STRINGING SAME

RELATED APPLICATION

This application is a continuation of Ser. No. 11/076,594, filed Mar. 10, 2005, now abandoned.

BACKGROUND OF THE INVENTION

1. Field of the Invention

This invention relates to jewelry. It relates more particularly to such jewelry consisting of hollow beads and similar ornaments strung on a support such as a chain or wire which can be engaged around a person's neck, wrist or ankle. In some cases the beads are spaced apart along the support; in other cases, they are arranged in groups which groups are spaced apart along the support. In either event, steps must be taken to provide stops for at least some of the beads to maintain the proper spacing of the individual beads or groups of beads along the support and to prevent them from sliding off the support in the event the support should break.

2. Description of the Prior Art

In conventional necklaces, bracelets, and the like the positions of some or all of the beads on the support are fixed by stops which may consist of drops of solder on the support that bracket each bead or group of beads. In the case where the support is a chain or wire, the chain or wire may be deformed to form a flat which cannot pass through the holes in the adjacent beads. In both cases, the stops, being located in the support outside the beads, may be visible and thus detract from the ornamental appearance of the necklace, bracelet or the like.

The conventional methods for locking beads are disadvantaged also in that the stops must be provided at the time the jewelry article is being assembled. This means that the arrangement of beads on the necklace, bracelet or the like is fixed by the time it is purchased by a customer. Thereafter there is no possibility of reconfiguring the beads on the jewelry article.

To address this problem, I have recently developed self locking beads which can be adjustably positioned on their supports; see U.S. Pat. No. 6,557,376. The self locking beads allow a purchaser of the jewelry article to reposition the beads on their supports to suit the desires of that purchaser. The self locking beads described in that patent consist of a shell having aligned holes for stringing the shell on a support. A plastic tube extends between the holes within the shell, the inner diameter of that tube being smaller than the diameter of the holes. When the bead is strung on a support such as a chain, the inner wall of the tube frictionally engages the links of the chain thereby holding the bead at a fixed location along the bead unless the bead is slid along the chain with sufficient force to overcome that frictional engagement.

While that self locking bead performs its function quite well, it is disadvantaged somewhat in that it is difficult to initially string the beads along a chain or other support because the inner wall of the included plastic tube is smaller than the bead holes so that the tube frictionally engages the chain or other support during the stringing process. Of course, increasing the inner diameter of the plastic tube in that patented bead would defeat the purpose of the invention there. In other words, the same feature which gives that prior bead its superior adjustable self locking function, also makes it more difficult to string that bead on its support in the first place. Bearing in mind that a given necklace may have a large number of my prior beads, the process of stringing a necklace with those beads can be a tedious and time consuming task.

SUMMARY OF THE INVENTION

Accordingly it is an object to the present invention to provide a necklace, bracelet, anklet or other beaded jewelry article whose beads can be strung easily on that article's chain or other support, yet can be permanently fixed easily at selected locations along that support.

Another object of the invention is to provide a jewelry article comprising a plurality of beads or hollow ornaments strung on a support wherein the beads or other ornaments can be permanently fixed at selected locations along the support at any time after the manufacture and assembly of the article.

A further object of the invention is to provide a hollow jewelry bead or ornament which can be made and sold in quantity for subsequent stringing on a chain or other support after which the bead may be permanently locked at a selected location along the support by means located entirely within the bead and not on the support.

Other objects will, in part, be obvious and will, in part, appear hereinafter.

The invention accordingly comprising the sequence of steps, features of construction, combination of elements and arrangement of parts which will be exemplified in the following detailed description, and the scope of the invention will be indicated in the claims.

Briefly, jewelry incorporating my invention includes an elongated slender support having strung thereon a multiplicity of beads and/or ornaments one or more of which is a special locking bead whose position along the support may be permanently fixed by means located entirely within that bead and not on the support. This allows the beads or other ornaments on the support to be spaced apart along the support or to be grouped along the support to suit the desires of the purchaser or wearer of the jewelry.

As will be described in more detail later, each of the locking beads comprises a hollow shell having a pair of diametrically opposite holes therein through which the chain or other bead support may be threaded. The bead also has incorporated therein at the time of its manufacture a plastic tube which is aligned with the holes in the shell and compressed between the wall portions of the shell around those holes so that the tube remains aligned with the holes. Preferably, the inside diameter of the plastic tube is no smaller than the holes in the shell so that the bead support may be threaded easily through the holes in the bead when stringing the bead.

In accordance with the invention, the aforesaid plastic tube is a heat shrinkable tube of the type commonly used in the electronics industry to insulate wire connections. This type of shrinkable tubing shrinks when heated by a relatively low temperature heat source such as a torch, hair dryer, match, candle, etc.

Thus jewelry beads and other similar ornaments equipped with such internal heat shrinkable tubes can be sold in quantity to a jeweler who may string the beads easily on a chain or other support and subsequently stop or lock selected beads by applying heat to those beads. That heat will shrink the shrinkable tubes within those locking beads allowing the jeweler to space or group the beads as desired along the support. Alternatively, the jeweler may sell the necklace or other jewelry article to a customer who may perform the heating step on the locking bead(s) so that the beads on a given necklace may be spaced or grouped along the support as desired by that customer.

As will be seen, a wide variety of different bead or ornament placements and groupings are possible for a given piece of jewelry such as a necklace, bracelet, anklet, brooch, earring, belt, etc.

BRIEF DESCRIPTION OF THE DRAWING

For a fuller understanding the nature and the objects of the invention, reference should be made to the following detailed description taken in connection with the accompanying drawing, in which.

DETAILED DESCRIPTION OF AN ILLUSTRATIVE EMBODIMENT

Figure 1:
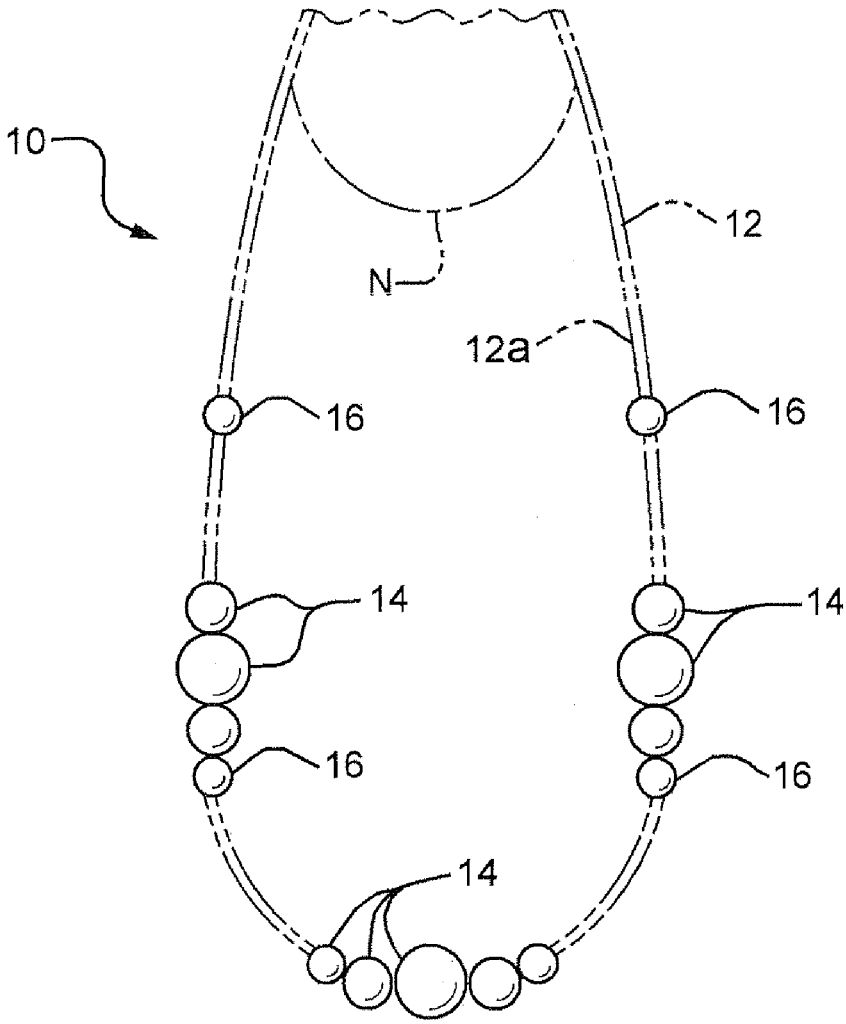
FIG. 1 is an elevational view of a beaded necklace including locking beads incorporating my invention positioned at different elevations on the necklace support to establish different bead groupings on that support.

Referring to FIG. 1 of the drawing, a necklace 10 incorporating the invention is shown hung around a wearer's neck N. The illustrated necklace includes a bead support 12 in the form of a chain composed of interlocking links 12*a* which may be of any metal or other material suitable for making jewelry. Of course, other bead supports are possible including strings, wires, tubes, etc. The illustrated necklace 10 has beads 14 and a plurality of special locking beads 16. The various beads 14 are arranged in groups with those groups being maintained at selected positions along support 12 by the locking beads 16 which may be permanently fixed to the support. Of course, in another necklace, all of the beads on support 12 may be locking beads 16 spaced apart along the support.

While necklace 10 has only one ornamental strand, it is obvious that the invention can be incorporated into a multiple strand necklace, bracelet, anklet, etc. which would allow a variety of different bead spacings and groupings along the different strands.

Figure 2B:
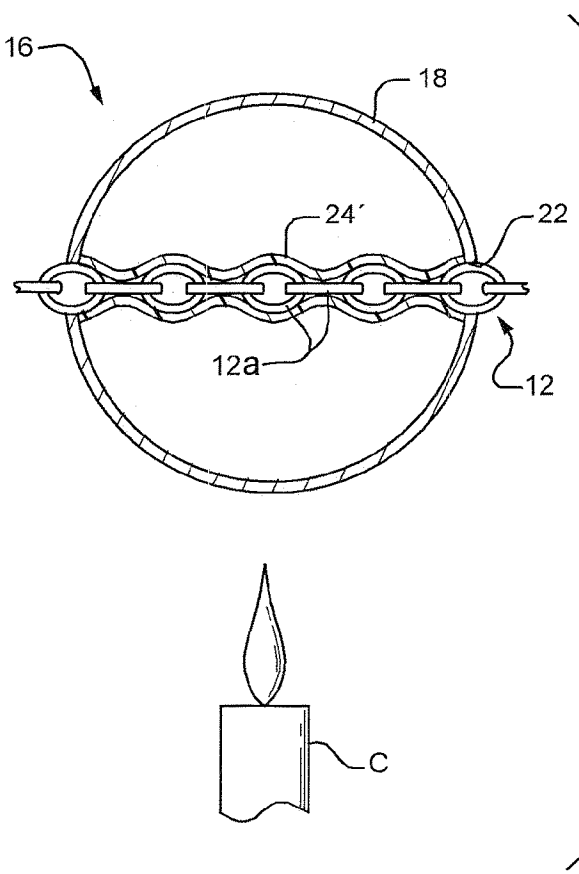
FIG. 2B is a similar view showing the same bead after the bead locking function is implemented.
Figure 2A:
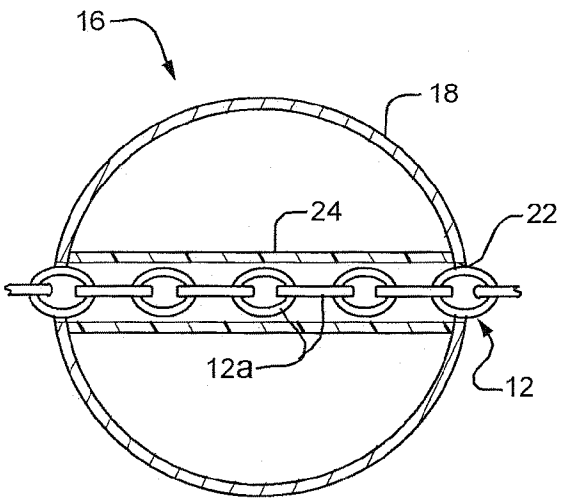
FIG. 2A is a view in medial section on a much larger scale showing one of the locking beads in the FIG. 1 necklace before the bead locking function is implemented.

Referring now to FIG. 2, each locking bead 16 comprises a thin shell 18 of any metal or alloy for making jewelry, e.g. gold, silver, platinum, stainless steel, brass, etc. The shell 18 has a pair of diametrically opposite holes 22 sized to slideably receive the support 12 so that the bead 16 can be strung easily on the support. At the time of its formation, the shell 18 is provided with an internal plastic tube 24 whose inside surface is preferably aligned with the edges of holes 22.

In accordance with the invention, the tube 24 is a so called heat-shrinkable tube of the type commonly used in the electrical industry to sheathe wire connections so as to insulate those connections.

Tube 24 may be incorporated into bead 16 at the time of its manufacture by the method disclosed in my U.S. Pat. No. 6,722,036, the contents of which are hereby incorporated herein by reference. The inside diameter of the tube should be more or less the same as the diameter of holes 22 in the shell 18 and the outside diameter of the tube should be slightly larger than those holes so that the tube is somewhat compressed lengthwise between the shell material around the holes whereby the tube remains aligned with the holes even if the bead should be impacted or jostled. Thus, the bead holes 22 as well as the tube 24 are sized so that the beads can be strung easily on the chain 12. In other words, the links 12*a* of the illustrated chain are rather loosely received within both the bead holes and the tube so that the beads 16 can be positioned easily at selected locations along the chain 12.

Referring now to FIG. 2B, after the beads 16 have been properly positioned along support 12, they may be permanently fixed or located at those locations by heating each bead 16 using a suitable heat source represented by the candle C in FIG. 2B. Since the shell 18 is of metal which is a thermally conductive material, the heating of each bead will cause the tube 24 within each bead to heat up and shrink diametrically as shown at 24' so that the inner wall of tube 24' will engage around and conform generally to support 12 thereby permanently anchoring each bead to the support. Due to the tight engagement of the ends of the tube 24' against the inner wall of the shell 18, the ends of that tube do not shrink as much as the middle segment of the tube so that the tube ends do not project through the holes 22 in the shell. It is important to note that each bead 16 is locked or fixed to the chain by means located entirely within each bead and without any alteration or deformation of support 12. Therefore, the bead locking function does not detract from the beauty of the necklace or other jewelry article.

It will thus be seen in the objects set forth above among those made apparent from the preceding description are efficiently attained. Also, since certain changes may be made in carrying out the above method and in the construction set forth without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention described herein.

What is claimed is:

1. A method of stringing beads comprising the steps of providing at least one stopping bead each including a substantially closed seamless metal shell having a pair of aligned holes therein and a heat-shrinkable plastic tube having a cross-section no smaller than said holes inside the shell in alignment with said holes;

threading an elongated slender support having a cross-section slightly smaller than that of said passage through said holes and said passage so that the shell is located at a selected location along the support;

providing additional beads having holes therein;

threading said support through the holes of the additional beads so that the additional beads are positioned along the support relative to said at least one stopping bead, and without heating the additional beads, locally heating the shell of said at least one stopping bead sufficiently to radially shrink the tube therein so that said tube therein engages tightly around the support thereby permanently fastening said at least one stopping bead to the support.

2. The method defined in claim 1 wherein the support is formed as a chain.

3. The method defined in claim 1 including the additional steps of positioning a plurality of said stopping beads at selected spaced-apart locations along the support so as to separate the additional beads into groups, and locally heating each stopping bead so as to permanently fix its position on the support.

* * * * *